US006086009A

United States Patent [19]

Skalleberg et al.

[11] Patent Number: 6,086,009

[45] Date of Patent: Jul. 11, 2000

[54] APPARATUS AND METHOD TO CATCH, DAMP AND FEED A CABLE, WIRE, ROPE OR THE LIKE WHICH IS ROLLED UP IN A RING

[75] Inventors: Öystein Skalleberg, Nyhamnsläge; Rolf Arnheden, Kungsängen; Bernt Gahn, Bålsta, all of Sweden

[73] Assignee: Skaltek AB, Kungsangen, Sweden

[21] Appl. No.: 09/214,183

[22] PCT Filed: Jun. 16, 1997

[86] PCT No.: PCT/SE97/01054

§ 371 Date: Jul. 12, 1999

§ 102(e) Date: Jul. 12, 1999

[87] PCT Pub. No.: WO98/00357

PCT Pub. Date: Jan. 8, 1998

[30] Foreign Application Priority Data

Jul. 1, 1996 [SE] Sweden ..... 9602608

[51] Int. Cl.[7] ..... B65H 54/22; B65H 67/04

[52] U.S. Cl. ..... 242/473.5

[58] Field of Search ..... 242/473.5, 473.8, 242/172, 125.2, 470, 473.6, 533, 533.2

[56] References Cited

U.S. PATENT DOCUMENTS

| | | | |
|---|---|---|---|
| 3,370,798 | 2/1968 | Hagihara et al. | 242/473.5 |
| 3,559,906 | 2/1971 | Krafft | 242/470 X |
| 4,041,684 | 8/1977 | Kamp . | |
| 4,175,711 | 11/1979 | Kamp . | |
| 4,634,069 | 1/1987 | Kataoka | 242/470 X |
| 4,723,885 | 2/1988 | Grube et al. | 242/470 X |
| 4,763,773 | 8/1988 | Kawarabashi et al. | 242/473.5 X |
| 4,982,561 | 1/1991 | Stranzke et al. | 242/473.5 X |
| 5,029,763 | 7/1991 | Grecksch et al. | 242/473.6 |
| 5,059,087 | 10/1991 | Mitani et al. | 242/473.5 X |
| 5,113,995 | 5/1992 | Sakurai | 242/473.5 X |
| 5,184,785 | 2/1993 | Inger et al. | 242/473.5 |
| 5,211,000 | 5/1993 | Fink et al. | 242/473.5 X |

FOREIGN PATENT DOCUMENTS 371 630 11/1974 Sweden .

*Primary Examiner*—Donald P. Walsh
*Assistant Examiner*—Collin A. Webb
*Attorney, Agent, or Firm*—Young & Thompson

[57] ABSTRACT

An apparatus and method for intercepting, damping and feeding a cable (1), wire, line or the like, rolled up into a coil (4), which coil (4) is intended to be fed in the radial direction of the coil (4). The apparatus includes first and second support rollers (10,11) which are rotatably arranged on first and second arms (15,16) which arms (15,16) are pivotable about first and second axes of rotation (17,18). The support rollers (10,11) and arms (15,16) are symmetrically arranged around an axis of symmetry (19) which passes through the geometric central axis (20) of the coil (4). A damper (29,30) is arranged at the respective arms and a transmission (21) is arranged on the respective axes of rotation (17,18) for symmetric control of the arms (15,16).

11 Claims, 5 Drawing Sheets

APPARATUS AND METHOD TO CATCH, DAMP AND FEED A CABLE, WIRE, ROPE OR THE LIKE WHICH IS ROLLED UP IN A RING

BACKGROUND OF THE INVENTION

The present invention relates to an apparatus for intercepting, damping and feeding a cable, wire, line or the like rolled up into a coil, which coil is intended to be fed in the radial direction of the coil. The invention also relates to a method for intercepting, damping and feeding a cable, wire, line or the like rolled up into a coil, which coil is intended to be fed in the radial direction of the coil, wherein the cable or the like is wound on a winding means to form a coil, whereafter the cable or the like is cut when the desired length has been rolled up, whereafter the coil is separated from the winding means and the coil is allowed to free fall under the influence of gravity in the radial direction of the coil.

According to SE-B-371 630, an apparatus is known in the prior art for winding a cable or the like. The cable is rolled up on a winding means to form a coil. A back and forth moving guide means distributes the cable evenly over the axial extent of the coil. When a desired length of cable has been rolled up on the winding means, the cable is cut by means of a moving means which moves the cable towards a knife. Thereafter the coil is removed from the winding means and allowed to fall free under the influence of gravity down into a wrapping in the shape of a cardboard box.

According to the above prior art technique the cardboard box holds the coil together so that the cable does not unwind or become deformed. It has, however, for cost reasons and from the environmental point of view been shown to be unsuitable to use a cardboard box as wrapping. It is more appropriate to package the rolled-up coil in a thin foil wrapping of, for example, reusable plastic or to completely eliminate the requirement for a wrapping surrounding the coil.

The problem which is the basis for the present invention is how to intercept the coil during free fall without the coil being deformed or unwound.

Another problem which is the basis for the invention is how to, after rolling up of the cable, shorten the end or arrange the end of the cable to lie against the coil.

A further problem which is a basis for the invention is how to turn the coil for out-feeding.

SUMMARY OF THE INVENTION

These problems are solved according to the invention through the apparatus comprising first and second support rollers which are rotatably arranged on first and second arms, respectively, which arms are pivotable about first and second axes of rotation respectively, the support rollers and arms being symmetrically arranged around an axis of symmetry which passes through the geometric central axis of the coil, a damping means being arranged on the respective arms, and a transmission being arranged on the respective axes of rotation for symmetric control of the arms.

The method for solving the above mentioned problems is characterized according to the invention by a first and a second support roller which, when in a raised first position, intercept the coil, by a guide wall, displaceable in the axial direction of the coil, guiding the coil during the fall, by the cooperating dampers of the support rollers in a controlled manner braking and damping the movement of the coil, by a control cylinder synchronously moving the support rollers to a sunken second position, by the coil being rotated in the second sunken position through the first support roller being rotated so that the cut-off end of the cable is minimized, by the displaceable guide wall compressing the coil in the axial direction, by a binding means binding a tape or the like diametrically around the coil, by the displaceable guide wall pulling the coil, in the band arranged around the coil, away from the binding means, and by the coil being outfed from the binding means through the support rollers being moved synchronously with a controlled movement to a sunken third position, during which movement the distance between the support rollers increases to a distance which is greater than the diameter of the coil, whereafter the coil leaves the support rollers with the help of the force of gravity.

When the coil has left the support rollers, the coil is received in a turning cassette, which comprises two maneuverable legs which hold the coil in the circumferential direction and a number of transport rollers which support the coil in the axial direction, which turning cassette is turned approximately 85° about a shaft which is perpendicular to the geometric central axis of the coil, after which rotation the turning cassette has an inclination of approximately 5°, which inclination permits the coil to roll on the transport rollers out of the turning cassette.

BRIEF DESCRIPTION OF THE DRAWINGS

The invention is described more closely with reference to the embodiment shown on the appended drawings, where.

DESCRIPTION OF THE PREFERRED EMBODIMENTS

Figure 1:
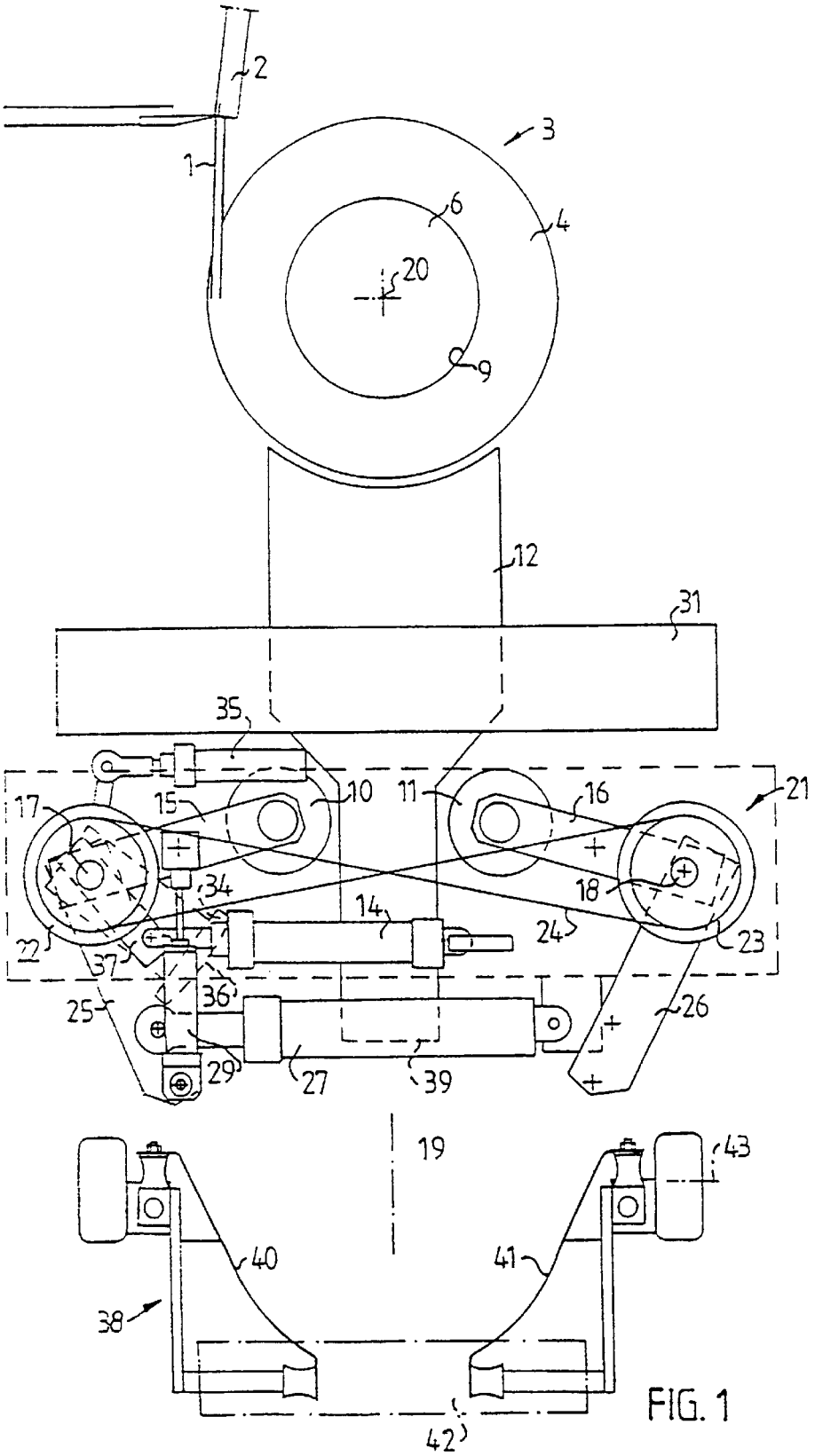
FIG. 1 shows a schematic view of an apparatus according to the invention, where a cable is rolled into a coil on a winding means.
Figure 5:
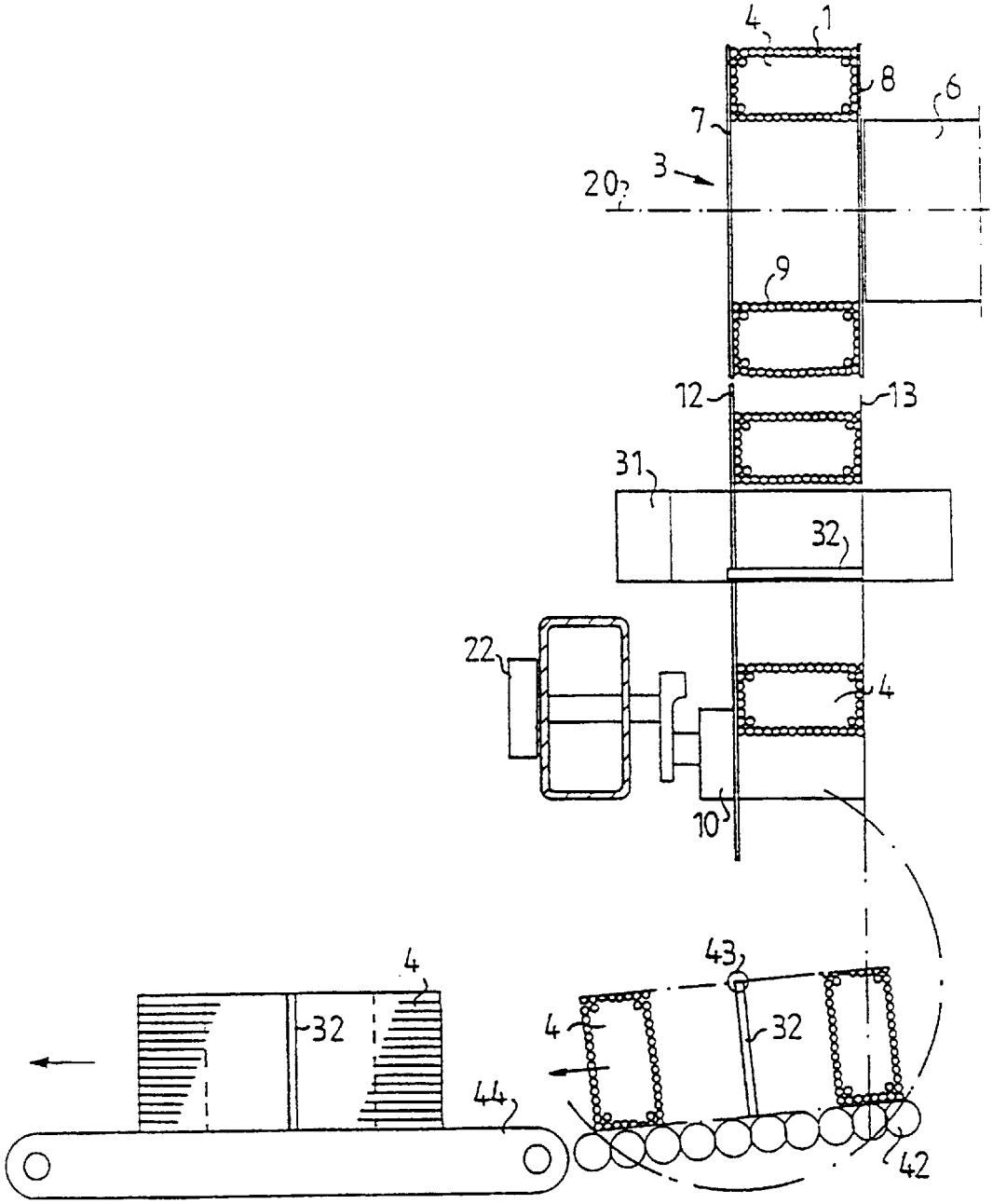
FIG. 5 shows a schematic side view of an apparatus according to the invention, where a coil is in a number of different positions in the apparatus.

FIG. 1 shows how a cable 1 is fed from a tube 2 and rolled up on a winding means 3. The cable 1 forms a coil 4 on the winding means 3. When a desired length of cable has been rolled up on the winding means 3, the cable 1 is cut, whereafter a loose cable end 5 is formed on the coil 4. The winding means 3 comprises partly a rotatable drum 6 which can be moved forwards and backwards in the axial direction of the formed coil 4 and partly two flanges 7,8 (FIG. 5) for supporting the cable 1 when it is being rolled up. The drum 6 is driven forwards and backwards in a central hole in the respective flanges 7,8. When the coil 4 has been coiled and the cable 1 has been cut, the drum 6 is fed out through the central hole 9 of the formed coil 4, whereafter the coil 4 leaves the flanges 7,8 and freefalls because of the force of gravity in the direction towards a first and a second support roller 10,11, as shown in FIG. 2.

During the free fall the coil 4 is guided by a guide wall 12 movable in the axial direction of the coil 4, which with a predetermined force presses the coil 4 against a fixed wall 13. The movable guide wall 12 is suitably maneuvered by a pneumatic cylinder (not shown). The free fall can consequently be controlled through increasing or reducing the force acting on the movable guide wall 12 and in this way increasing respectively reducing the friction between the coil 4 and respective walls 12,13.

Figure 2:
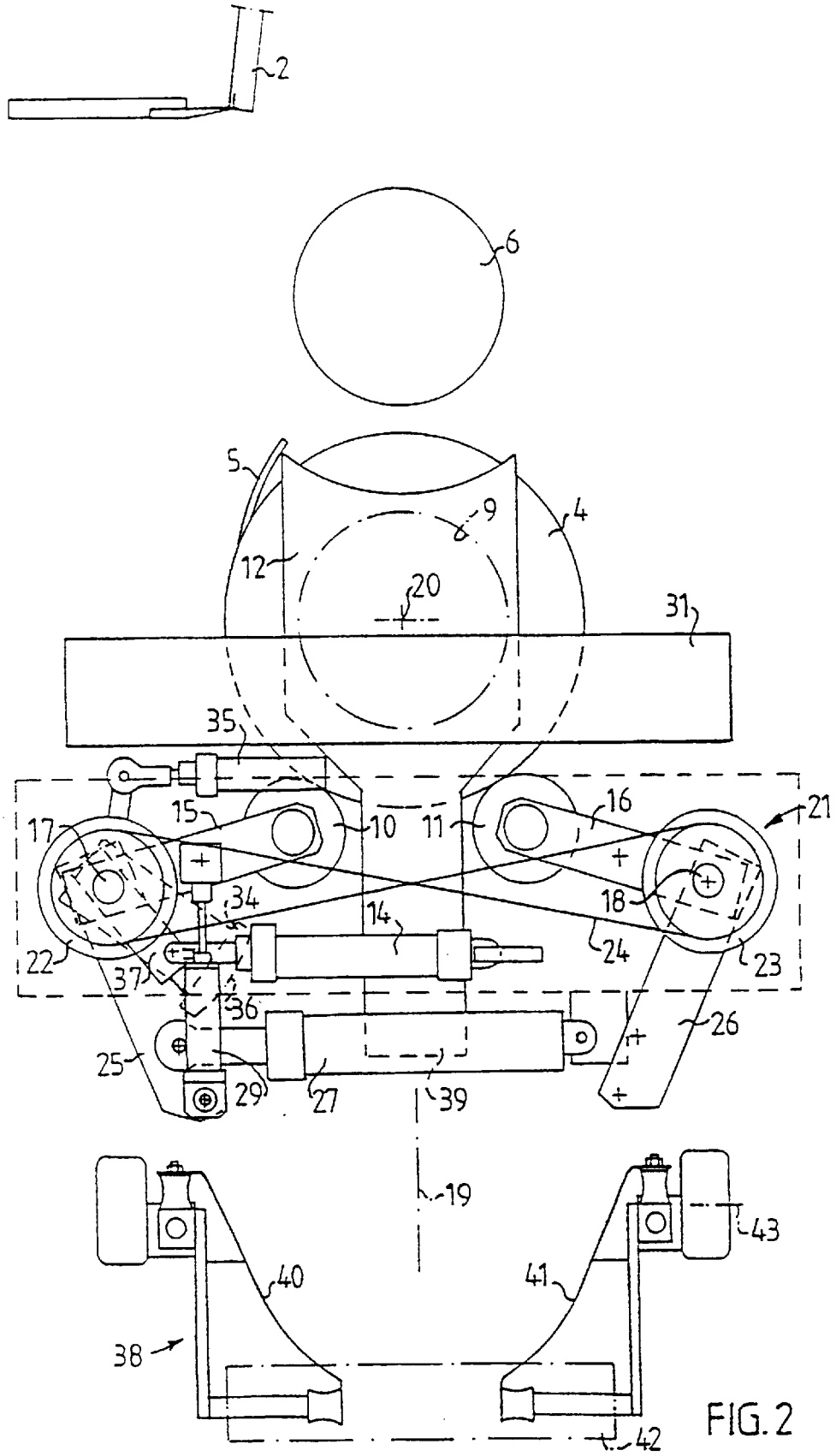
FIG. 2 shows a schematic view of an apparatus according to the invention, where a coil is in free fall and is intercepted by a pair of support rollers which are in a raised first position.

According to FIG. 2 the coil 4 is intercepted by a first and a second support roller 10,11, which are in a raised first position. A control cylinder 14 is arranged to ensure that the support rollers 10,11 are in the raised first position when the coil 4 is released from the winding means 3.

As is shown in FIGS. 1 and 2 the device comprises a first and second support roller 10,11, which are rotatably arranged on first and second arms 15,16 respectively, which arms 15,16 are pivotable about first and second axes of rotation 17,18 respectively. The guide rollers 10,11 and the arms 15,16 are symmetrically arranged about an axis of symmetry which passes through the geometric central axis 20 of the coil 4. A damping means 29,30 is arranged on the respective arms 15,16 and a transmission 21 is arranged on the respective axes of rotation for symmetric control of the arms 15,16. The transmission 21 comprises a toothed belt pulley 22,23 arranged on each of the respective axes of rotation 17,18, which cooperate with a crossed toothed belt 24 in order to obtain a symmetric movement of the respective arms 15,16 and support rollers 10,11.

The damping means 29,30 is formed of first and second progressive hydraulic dampers 29,30 which, on the one hand, are arranged on their respective arms 15,16 and, on the other hand, on first and second lever arms 25,26 respectively, which are mounted in bearings on the first and second axes of rotation 17,18 respectively. First and second power cylinders 27,28 are connected to the respective lever arms 25,26 in order to, on the one hand, adjust and fix the position of the respective lever arms 25,26 about the respective axes of rotation 17,18 and, on the other hand, in order to take up the reaction forces from the respective dampers 29,30.

In FIGS. 1 and 2 the second damper 30 and the second power cylinder 28 are left out, wherefore only the mounting points for these elements are shown.

Figure 3:
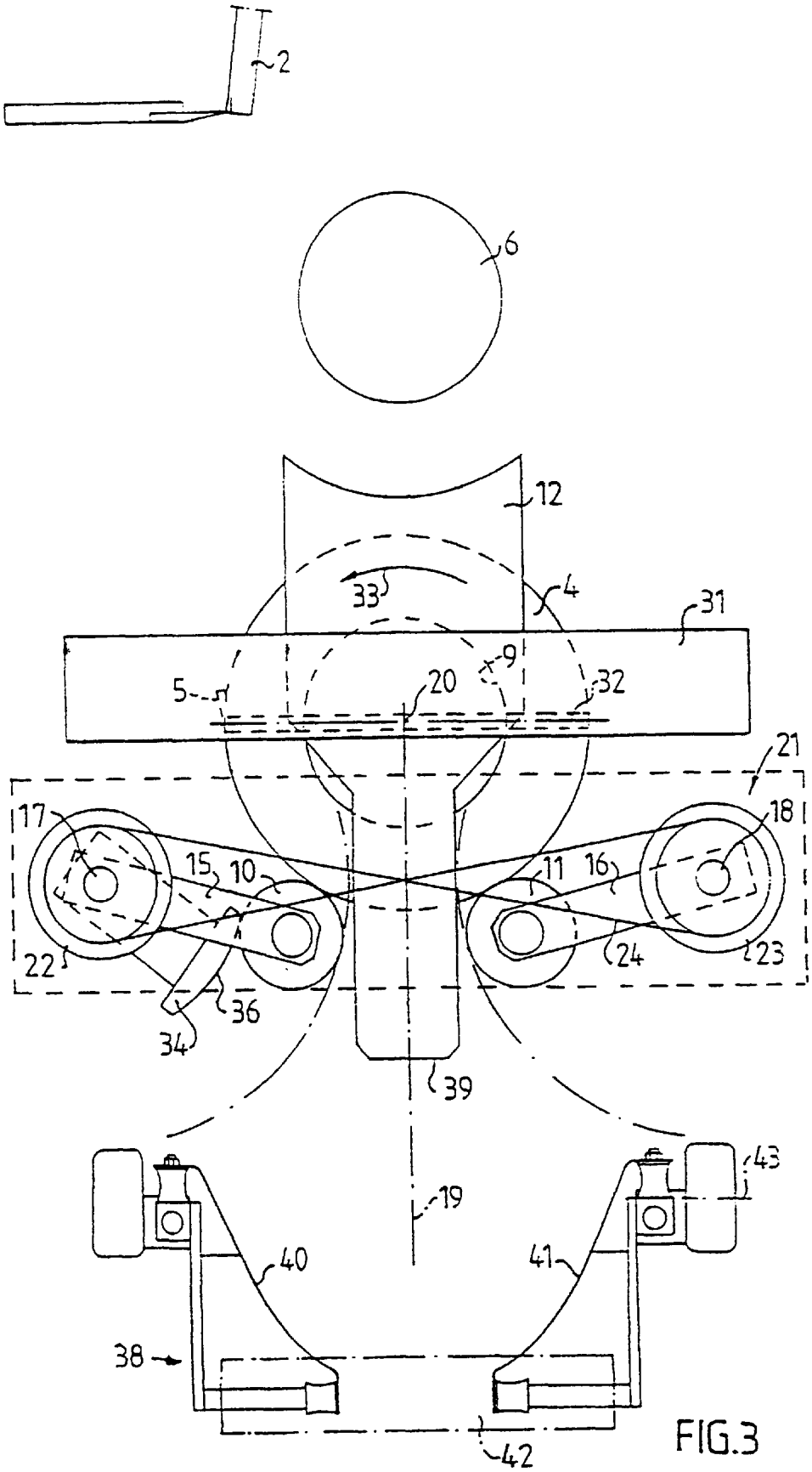
FIG. 3 shows a schematic view of an apparatus according to the invention, where a coil has been intercepted and damped by the support rollers which are in a sunken second position.

In FIG. 3 the coil 4 is intercepted and dampened by the support rollers 10,11, which because of the coil's weight and force are moved to a sunken second position. In this position the coil 4 is in a binding means 31, which is arranged to bind up the coil 4 diametrically by means of a band 32 or the like. Before the coil 4 is bound by means of the band 32, the coil 4 is rotated a predetermined angle in the direction of arrow 33 in order to minimize the cut-off end 5 of the cable. The rotation of the coil 4 takes place by means of a cam mechanism 34 which is rotatably arranged on the first axis of rotation 17 and is actuated by a cylinder 35. The cam mechanism 34 comprises a cam surface 36 which is intended to, through contact against the first support wheel 10, rotate the same and thereby the coil 4. The coil 4 is compressed in the axial direction by means of the movable guide wall 12 before the binding of the coil 4, whereby the band 32 which binds the coil 4 will also enclose the movable guide wall 12.

If the coil 4 has such a little weight that it is not capable of pushing down the support rollers 10,11 in the sunken second position, the control cylinder 14 moves, via a guide link 37, on the one hand the first arm 15 and on the other hand, by means of transmission 21, the second arm 16 and thereby the support rollers 10,11 to the sunken second position.

In FIG. 3 a number of elements which are shown in FIGS. 1 and 2 have been removed for the purpose of clarity.

Figure 4:
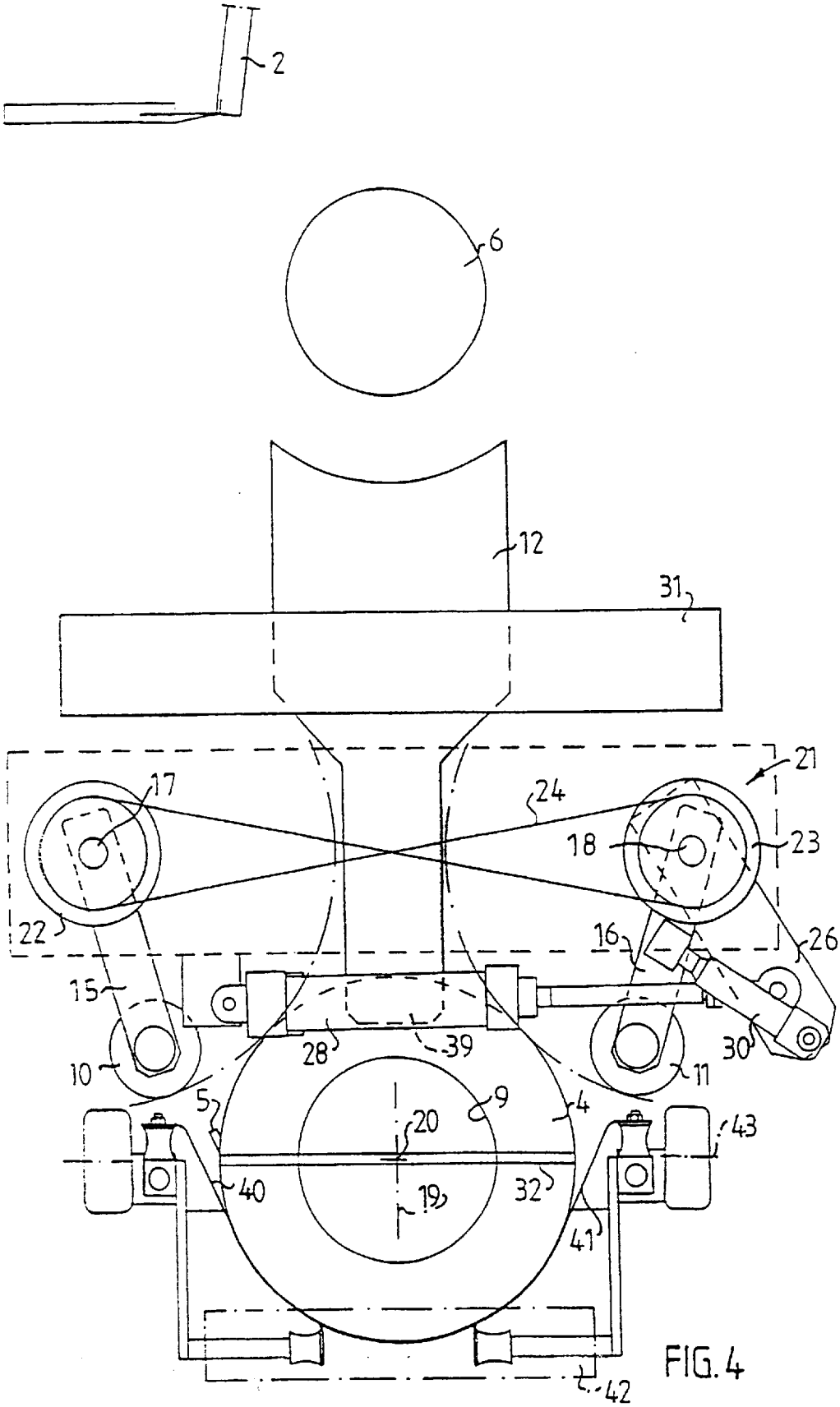
FIG. 4 shows a schematic view of an apparatus according to the invention, where a coil has been fed into a turning cassette and the support rollers sunken to a sunken third position.

In FIG. 4 it is shown how the coil 4 has been fed out from the binding means 31 and fed to a turning cassette 38. The feeding out from the binding arrangement 31 takes place through the support rollers 10,11 moving synchronously and with a controlled movement to a sunken third position during which movement the distance between the support rollers 10,11 increases to a distance which is greater than the diameter of the coil 4, whereafter the coil 4 leaves the support rollers 10,11 with the help of the force of gravity and ends up in the turning cassette 38. Before the coil 4 is fed out of the binding arrangement 31, the displaceable wall 12 pulls the coil 4 in the band 32 arranged around the coil 4 towards itself away from the binding arrangement 31 in the axial direction. This is so that the band 32 should not fasten in the binding arrangement 31 during the feeding out thereof. The movable guide wall 12 has a free end 39 in the feed direction, which means that the band 32 cannot come into conflict with the movable guide wall 12 when the coil 4 is fed out of the binding arrangement 31.

In FIG. 4 the second power cylinder 28, cooperating with the second lever arm 26, and the damper 30 are shown. Elements which are shown in FIGS. 1–3 have been left out for the sake of clarity.

The turning cassette 38 comprises two maneuverable legs 40,41, which fix the coil 4 in the circumferential direction and a number of transport rollers 42 which support the coil 4 in the axial direction. Only one transport roller 42 is schematically shown in FIGS. 1–4. The turning cassette 38 is rotatable about an axis 43, which is perpendicular to the geometric central axis 20. When the turning cassette 38 is rotated approximately 85° about the axis 43, the plane formed by the transport rollers 42 takes up an inclination of approximately 5°. This inclination allows the coil 4 to roll out of the turning cassette 38 and over, for example, a conveyor belt 44 for further processing, such as wrapping in foil or the like.

What is claimed is:

1. An apparatus for intercepting, damping and feeding a coil, the apparatus comprising:

first and second support rollers and first and second arms on which said first and second support rollers are arranged respectively, said first and second arms being pivotable about first and second axes of rotation respectively, said first and second support rollers being symmetrically arranged about an axis of symmetry through which a central axis of the coil passes;

damping means on said first and second arms for damping movement of said first and second arms; and a fixed wall and a guide wall that is arranged to press the coil against said fixed wall with a predetermined force.

2. The apparatus of claim 1, wherein said guide wall is movable in an axial direction of the coil.

3. The apparatus of claim 1, further comprising binding means for binding the coil with a band.

4. The apparatus of claim 3, wherein said guide wall draws the coil away from said binding means.

5. The apparatus of claim 1, further comprising first and second lever arms that rotate about the respective first and second axes of rotation, wherein said damping means comprises first and second hydraulic dampers that are connected to the first and second arms respectively and to said first and second lever arms respectively, and further comprising first and second power cylinders connected to said first and second lever arms respectively.

6. The apparatus of claim 1, further comprising a control cylinder connected to rotate the first and second axes of rotation from a first position to a second position.

7. The apparatus of claim 1, further comprising a cam mechanism with a cam surface that rotates one of said first and second support rollers to rotate the coil.

8. The apparatus of claim 1, further comprising a transmission having first and second toothed belt pulleys on said first and second axes of rotation respectively and a toothed belt cooperating with said first and second toothed belt pulleys, said transmission symmetrically moving said first and second arms.

9. The apparatus of claim 11, further comprising a turning cassette with two maneuverable legs for fixing the coil in a circumferential direction, plural transport rollers for supporting the coil in an axial direction, said turning cassette being rotatable about an axis perpendicular to the axis of symmetry.

10. Method for intercepting, damping and feeding a cable (1), wire, or line rolled up into a coil (4), which coil (4) is intended to be fed in the radial direction of the coil (4), wherein the cable (1), wire or line is rolled up on a winding means (3) to form the coil (4), whereafter the cable (1), wire or line is cut when the desired length has been rolled up, whereafter the coil (4) is removed from the winding means (3), and the coil (4) by means of the force of gravity is allowed to fall free in the radial direction of the coil (4), the method comprising the steps of:

intercepting the coil with a first and a second support roller (10,11), which are in a raised first position;

guiding the coil with a guide wall (12) movable in the axial direction of the coil (4) during the fall;

braking and damping movement of the coil with dampers (29,30) cooperating with the support rollers (10,11) in a controlled way;

moving the support rollers synchronously with a control cylinder (14) to a sunken second position;

in the second sunken position, rotating the coil (4) by turning the first support roller (10) so that the cut-off end (5) of the cable (1) is minimized;

compressing the coil with the movable guide wall (12);

binding a band (32) diametrically around the coil (4) with a binding arrangement;

the movable guide wall (12) drawing the coil in the band (32) away from the binding arrangement (31); and feeding the coil (4) out from the binding arrangement (31) by synchronously moving the support rollers (10,11) with a controlled movement to a sunken third position, during which movement the distance between the support rollers (10,11) increases to a distance which is greater than the diameter of the coil (4), whereafter the coil (4) leaves the support rollers (10,11) by means of the force of gravity.

11. The method according to claim 10, further comprising the step of intercepting the coil when the coil leaves the support rollers (10,11) in a turning cassette (31) which comprises two maneuverable legs (40,41) which fix the coil (4) in the circumferential direction, and a number of transport rollers (42) which support the coil (4) in the axial direction, which turning cassette (38) is rotated approximately 85° around an axis (43) which is perpendicular to the geometric central axis (20) of the coil (4), after which rotation the turning cassette (38) has an inclination of approximately 5°, which inclination permits the coil (4) to roll out of the turning cassette (38) on the transport rollers (42).

* * * * *